US007320853B2

(12) United States Patent
Chou et al.

(10) Patent No.: US 7,320,853 B2
(45) Date of Patent: Jan. 22, 2008

(54) LIQUID TONERS COMPRISING AMPHIPATHIC COPOLYMERIC BINDER THAT HAVE BEEN PREPARED, DRIED AND REDISPERSED IN THE SAME CARRIER LIQUID

(75) Inventors: Hsin Hsin Chou, Woodbury, MN (US); Manuel Lozada, New Brighton, MN (US); Brian Teschendorf, Vadnais Heights, MN (US); A. Kristine Fordahl, St. Paul, MN (US)

(73) Assignee: Samsung Electronics Company, Suwon (KR)

( * ) Notice: Subject to any disclaimer, the term of this patent is extended or adjusted under 35 U.S.C. 154(b) by 376 days.

(21) Appl. No.: 10/978,636

(22) Filed: Oct. 31, 2004

(65) Prior Publication Data

US 2006/0093950 A1 May 4, 2006

(51) Int. Cl.
*G03G 5/00* (2006.01)

(52) U.S. Cl. ..... 430/137.22; 430/114

(58) Field of Classification Search ..... 430/137.22, 430/114

See application file for complete search history.

(56) References Cited

U.S. PATENT DOCUMENTS

| | | | |
|---|---|---|---|
| 3,411,936 | A | 11/1968 | Roteman et al. |
| 4,052,325 | A | 10/1977 | Santilli |
| 4,413,048 | A | 11/1983 | Landa |
| 4,886,726 | A | 12/1989 | Chan et al. |
| 5,229,235 | A | 7/1993 | Watanabe et al. |
| 5,254,425 | A | 10/1993 | Suzuki et al. |
| 5,612,162 | A | 3/1997 | Lawson et al. |
| 5,652,282 | A | 7/1997 | Baker et al. |
| 6,132,922 | A | 10/2000 | Fukae et al. |
| 6,287,741 | B1 | 9/2001 | Marko |
| 6,546,221 | B2 | 4/2003 | Baker et al. |
| 6,579,654 | B1 | 6/2003 | Marko |
| 6,620,569 | B2 | 9/2003 | Tsubuko et al. |
| 6,647,234 | B2 | 11/2003 | Herman et al. |
| 6,649,316 | B2 | 11/2003 | Baker et al. |
| 2004/0091807 | A1 | 5/2004 | Qian et al. |
| 2004/0091808 | A1 | 5/2004 | Qian et al. |
| 2004/0091809 | A1 | 5/2004 | Qian et al. |

OTHER PUBLICATIONS

Co-pending U.S. Appl. No. 10/880,799, filed Jun. 30, 2004 entitled "Extrusion Drying Process for Toner Particles Useful in Electrography", in the name of Moudry et al.

Co-pending U.S. Appl. No. 10/881,637, filed Jun. 30, 2004 entitled "Drying Process for Toner Particles Useful in Electrography", in the name of Chou et al.

Co-pending U.S. Appl. No. 10/978,652, filed Oct. 31, 2004 entitled "Liquid Toners Comprising Toner Particles Prepared in a Solvent Other Than the Carrier Liquid", in the name of Chou et al.

Co-pending U.S. Appl. No. 10/978,671, filed Oct. 31, 2004 entitled "Printing Systems and Methods for Liquid Toners Comprising Dispersed Toner Particles", in the name of Chou et al.

*Primary Examiner*—Mark A. Chapman
(74) *Attorney, Agent, or Firm*—Kagan Binder, PLLC

(57) ABSTRACT

Methods of preparing a liquid electrographic toner composition are provided, wherein a polymeric binder comprising at least one amphipathic copolymer comprising one or more S material portions and one or more D material portions is first prepared in a reaction solvent, wherein the reaction solvent comprises less than about 10% aromatic components by weight and has a Kauri-Butanol number less than about 30 mL. Toner particles are then formulated in the reaction solvent and dried. The dried toner particles are then redispersed in a carrier liquid that has substantially the same chemical constitution as the reaction solvent to form a redispersed liquid electrographic toner composition. Products and kits are also provided.

19 Claims, No Drawings

LIQUID TONERS COMPRISING AMPHIPATHIC COPOLYMERIC BINDER THAT HAVE BEEN PREPARED, DRIED AND REDISPERSED IN THE SAME CARRIER LIQUID

FIELD OF THE INVENTION

The present invention relates to liquid toner compositions having utility in electrography. More particularly, the invention relates to liquid toner compositions comprising an amphipathic copolymer binder that have been prepared in a reaction solvent, dried and then redispersed in substantially the same solvent to form a liquid toner composition.

BACKGROUND OF THE INVENTION

In electrophotographic and electrostatic printing processes (collectively electrographic processes), an electrostatic image is formed on the surface of a photoreceptive element or dielectric element, respectively. The photoreceptive element or dielectric element can be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227-252, and U.S. Pat. Nos. 4,728,983, 4,321,404, and 4,268,598.

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which can also be referred to as "light," can include infrared radiation, visible light, and ultraviolet radiation, for example.

In the development step, toner particles of the appropriate polarity are generally brought into contact with the latent image on the photoreceptor, typically using a developer electrically-biased to a potential having the same polarity as the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative surface energies between the ink, a photoreceptor surface and a temporary carrier surface or medium for the toner. The effectiveness of such elastomeric assist or adhesive transfer is controlled by several variables including surface energy, temperature, pressure, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer can be influenced by surface energy, temperature, and pressure, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, any residual toner remaining on the photoreceptor and/or intermediate transfer element is removed. Finally, in the erasing step, the photoreceptor charge is reduced to a substantially uniformly low value by exposure to light of a particular wavelength band, thereby removing remnants of the original latent image and preparing the photoreceptor for the next imaging cycle.

Electrophotographic imaging processes can also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either by via an intermediate transfer member or directly. One example of such a process is described in U.S. Pat. No. 5,432,591.

A single-pass electrophotographic process for developing multiple color images is also known and can be referred to as a tandem process. A tandem color imaging process is discussed, for example in U.S. Pat. Nos. 5,916,718 and 5,420,676. In a tandem process, the photoreceptor accepts color from developer stations that are spaced from each other in such a way that only a single pass of the photoreceptor results in application of all of the desired colors thereon.

Alternatively, electrophotographic imaging processes can be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a carrier liquid. The carrier liquid is typically a nonconductive dispersant, to avoid discharging the latent electrostatic image. Liquid toner particles are generally solvated to some degree in the carrier liquid (or carrier fluid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the carrier liquid. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227-252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter between 0.1-1 micron. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68-74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter between 3-10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

U.S. Pat. No. 5,254,425 discloses a self-dispersing graft-copolymer capable of self-dispersion in a high-electrical insulating carrier liquid to form grains therein. A toner kit is also provided that is composed of a complete solid toner and a carrier liquid. The copolymers as described in this patent are all made in a toluene carrier liquid.

The art continually searches for improved liquid toner compositions that are storage stable and that produce high quality, durable images on a final image receptor.

SUMMARY OF THE INVENTION

The present invention relates to a method of preparing a liquid electrographic toner composition, wherein a polymeric binder is first prepared in a reaction solvent that comprises less than about 10% aromatic components by weight and has a Kauri-Butanol number less than about 30 mL. The polymeric binder comprises at least one amphipathic copolymer comprising one or more S material portions and one or more D material portions. Toner particles comprising this polymeric binder are then formulated in the reaction solvent. The toner particles are then dried to provide a dry toner particle composition. Finally, the dry toner particle composition is redispersed in a carrier liquid having substantially the same chemical constitution as the reaction solvent to form a redispersed liquid electrographic toner composition. For purposes of the present invention, a carrier liquid is considered to have substantially the same chemical constitution as the reaction solvent if it varies in components in chemical content in minor amounts, such as less than about 10% by weight, and in identity in a manner that does not affect the overall solvent properties (such as polarity, solubility parameter, and so on) of the carrier liquid as compared to the reaction solvent. Preferably, the reaction solvent is a hydrocarbon solvent.

Because substantially the same solvent is used as the reaction solvent and the carrier liquid, the toner particle composition can be readily formulated to provide exceptionally easy redispersion of the dry toner composition in the carrier liquid. Further, since the same solvent is used, all components as provided in the reaction solvent will have exactly the same and predictable compatibilities with the carrier liquid. The resulting redispersed liquid electrographic toner composition surprisingly exhibits superior properties in viscosity, storage and imaging properties as compared to like liquid toners that have not been dried and redispersed. Toners of the present invention are surprisingly lower in viscosity as compared to like liquid toners that have not been dried and redispersed, thereby providing a lower viscosity liquid toner and/or enabling production of liquid toners having a desired low viscosity with a higher solids content. Further, liquid toners that have been redispersed as described herein can be more storage stable as compared to like liquid toners that have not been dried and redispersed because of the excellent dispersion characteristics of the redispersed toner particles. The present redispersed toner liquid compositions have been found to maintain relatively homogeneous dispersions without undesired settling and aggregation issues.

Additionally, the present process provides a dry stage in the production process, which may be used in production and transportation to utilize material handling advantages of this state. In one embodiment of the present invention, the toner composition can be prepared, dried and stored and/or transported in the dry state prior to redispersion in a carrier liquid. In this embodiment, the dry toner particle composition is readily stored with substantially reduced fire hazards, with little or no charge equilibrium change as can be experienced in liquid toners during storage, and with no settling or caking issues that can occur when storing liquid toners in long-term storage. Additionally, the dry toner particle composition take up less space and are less heavy than the corresponding liquid toner compositions, providing further storage and shipping advantages. Additionally, provision of toner in a dry state prior to redispersion provides an opportunity to easily premix dry toners to average out batch variations, thereby providing superior lot-to-lot consistency. In a preferred aspect of the present invention, the dry toner particle compositions are stored as relatively low cost and high stability inventory for periods of greater than 3 weeks after production, and preferably for greater than 2 months after production, prior to redispersion in a liquid carrier to form a liquid toner composition.

In one embodiment, the dry toner particle composition can be stored at or near the manufacturing site, and redispersed easily and quickly in a carrier liquid upon receipt of an order from a customer in a "just in time" or "on demand" supply process. In another embodiment, the dry toner particle composition can be packaged in refill quantities and containers for shipping to a distributor or the ultimate customer for redispersion by a non-manufacturing party in location closer to the site of ultimate use, or at the site of ultimate use of the toner. Shipping of only the dry toner phase of the present toner composition provides advantages in reduction of weight of product to be shipped as a final product, transport and storage condition advantages, and reduced flammability hazards.

In yet another embodiment, the dry toner particle composition can be provided together with a carrier liquid in a two-part kit, with instructions for dispersion of the dry toner with the carrier liquid at or near the site of use of the toner. In a preferred embodiment, the dry toner particle composition and the carrier liquid are provided in containers that are designed to cooperatively work together to facilitate redispersion of the dry toner particle composition in the carrier liquid.

Images formed from redispersed toner compositions as described herein exhibit superior performance in overall print quality and optical density as compared to like liquid toners that have not been dried and redispersed. In particular, the toners of the present invention exhibit excellent toner conductivity properties. While not being bound by theory, it is believed that the observed beneficial reduced conductivity is due to reduced counterion presence in the final toner composition as a result of the redispersion process described herein.

Preferably, the S material portions of the amphipathic copolymer comprise a plurality of anchoring groups, thereby providing an amphipathic copolymer having a plurality of links between the individual S material portions and the D material portions. The structure of the amphipathic copolymer provides a distinct advantage as compared to graft copolymers having on only one link or attachment point between soluble components and insoluble components, because the resulting copolymer is more stable and resistant to stresses that could cause the S material portion and D material portion to separate. Thus, the particle may be exposed to agitation, solvent effects, and physical stresses such as deagglomeration without separation of the S material portion and D material portion from each other.

DETAILED DESCRIPTION OF PRESENTLY PREFERRED EMBODIMENTS

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

The toner particles of the liquid toner composition comprise a polymeric binder that comprises an amphipathic copolymer. As used herein, the term "amphipathic" refers to a copolymer having a combination of portions having distinct solubility and dispersibility characteristics in a desired reaction solvent that is used to make the organosol and/or used in the course of preparing the liquid toner particles, and carrier liquid used for formulating the ultimate redispersed toner liquid composition. The reaction solvent that is used as the solvent in the polymerization reaction and as the carrier liquid to form the redispersed liquid electrographic toner composition is selected such that at least one portion (also referred to herein as S material or portion(s)) of the copolymer is more solvated by the carrier while at least one other portion (also referred to herein as D material or portion(s)) of the copolymer constitutes more of a dispersed phase in the carrier. Preferred amphipathic copolymers are prepared by first preparing an intermediate S material portion comprising reactive functionality by a polymerization process, and subsequently reacting the available reactive functionalities with a graft anchoring compound. The graft anchoring compound comprises a first functionality that can be reacted with the reactive functionality on the intermediate S material portion, and a second functionality that is a polymerizably reactive functionality that can take part in a polymerization reaction. After reaction of the intermediate S material portion with the graft anchoring compound, a polymerization reaction with selected monomers can be carried out in the presence of the S material portion to form a D material portion having one or more S material portions grafted thereto.

The resulting polymeric binder is then mixed with necessary additives, such charge directors, visual enhancement additives and the like, to form a toner particles. During such combination, ingredients comprising the additives and the copolymer will tend to self-assemble into composite particles having solvated (S) portions and dispersed (D) portions. For example, it is believed that the D material of the copolymer will tend to physically and/or chemically interact with the surface of the visual enhancement additive, while the S material helps promote dispersion in the carrier.

The reaction solvent and the carrier liquid of the organosol is selected such that at least one portion (also referred to herein as the S material or shell portion) of the amphipathic copolymer is more solvated by the carrier while at least one other portion (also referred to herein as the D material or core portion) of the copolymer constitutes more of a dispersed phase in the carrier. In other words, preferred copolymers of the present invention comprise S and D material having respective solubilities in the desired reaction solvent and the carrier liquid that are sufficiently different from each other such that the S blocks tend to be more solvated by the carrier while the D blocks tend to be more dispersed in the carrier. More preferably, the S blocks are soluble in the reaction solvent and the carrier liquid while the D blocks are insoluble. In particularly preferred embodiments, the D material phase separates from the reaction solvent and the carrier liquid, forming dispersed particles.

From one perspective, the polymer particles when dispersed in the reaction solvent and the carrier liquid can be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the reaction solvent and the carrier liquid. Consequently, the S material can also be referred to herein as a "graft stabilizer." The core/shell structure of the binder particles tends to be retained when the particles are dried when incorporated into liquid toner particles.

The solubility of a material, or a portion of a material such as a copolymeric portion, can be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H/RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters*, 2d Ed. CRC Press, Boca Raton, Fla., (1991), for monomers and representative polymers in *Polymer Handbook*, 3rd Ed., J. Brandrup & E. H. Immergut, Eds. John Wiley, N.Y., pp 519-557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a solvent or a carrier liquid can be predicted from the absolute difference in Hildebrand solubility parameters between the material, or portion thereof, and the solvent or the carrier liquid. A material, or portion thereof, will be fully soluble or at least in a highly solvated state when the absolute difference in Hildebrand solubility parameter between the material, or portion thereof, and the solvent or carrier liquid is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the solvent or carrier liquid, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the solvent or carrier liquid.

Consequently, in preferred embodiments, the absolute difference between the respective Hildebrand solubility parameters of the S material portion(s) of the copolymer and the solvent or carrier liquid is less than 3.0 $MPa^{1/2}$. In a preferred embodiment of the present invention, the absolute difference between the respective Hildebrand solubility parameters of the S material portion(s) of the copolymer and the solvent or carrier liquid is from about 2 to about 3.0 $MPa^{1/2}$. In a particularly preferred embodiment of the present invention, the absolute difference between the respective Hildebrand solubility parameters of the S material portion(s) of the copolymer and the solvent or carrier liquid is from about 2.5 to about 3.0 $MPa^{1/2}$. Additionally, it is also preferred that the absolute difference between the respective Hildebrand solubility parameters of the D material portion(s) of the copolymer and the solvent or carrier liquid is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D material portion(s) is at least about 0.4 $MPa^{1/2}$, more preferably at least about 1.0 $MPa^{1/2}$. Because the solubility of a material can vary with changes in temperature, such solubility parameters are preferably determined at a desired reference temperature such as at 25° C.

Those skilled in the art understand that the Hildebrand solubility parameter for a copolymer, or portion thereof, can be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446-448. Thus, there will be a preferred molecular weight range for a given polymer or portion thereof in order to achieve desired solvating or dispersing characteristics. Similarly, the Hildebrand solubility parameter for a mixture can be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrographic toner and the Hildebrand solubility parameters and glass transition temperatures (based on their high molecular weight homopolymers) for some common monomers used in synthesizing organosols.

TABLE I

Hildebrand Solubility Parameters
Solvent Values at 25° C.

| Solvent Name | Kauri-Butanol Number by ASTM Method D1133-54T (ml) | Hildebrand Solubility Parameter ($MPa^{1/2}$) |
|---|---|---|
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

Monomer Values at 25° C.

| Monomer Name | Hildebrand Solubility Parameter ($MPa^{1/2}$) | Glass Transition Temperature (° C.)* |
|---|---|---|
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (28 m.p.)** |
| n-Octadecyl Acrylate | 16.82 | −55 (42 m.p.)** |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Calculated using Small's Group Contribution Method, Small, P. A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209–277 (1989). The $T_g$ listed is for the homopolymer of the respective monomer.
**m.p. refers to melting point for selected Polymerizable Crystallizable Compounds.

The reaction solvent and the carrier liquid are substantially nonaqueous, solvents or solvent blends, comprising less than about 10% aromatic components. In other words, only a minor component (generally less than 25 weight percent) of the solvent or carrier liquid comprises water. Preferably, the substantially nonaqueous solvent or carrier liquid comprises less than 20 weight percent water, more preferably less than 10 weight percent water, even more preferably less than 3 weight percent water, most preferably less than one weight percent water. It has been found that incorporation of aromatic components in the reaction solvent or the carrier liquid adversely affects the imaging properties of the ultimate toner composition. Preferably, the reaction solvent and the carrier liquid are hydrocarbon solvents.

The substantially nonaqueous reaction solvent or carrier liquid can be selected from a wide variety of materials, or combination of materials, which are known in the art, but preferably has a Kauri-butanol number less than 30 ml. The reaction solvent or carrier liquid is preferably chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the reaction solvent or carrier liquid desirably is chemically inert in most embodiments with respect to the ingredients used to formulate the toner particles.

Examples of suitable liquids for use as a reaction solvent in the polymerization reaction include aliphatic hydrocarbons (n-pentane, hexane, heptane and the like), cycloaliphatic hydrocarbons (cyclopentane, cyclohexane and the like), halogenated hydrocarbon solvents (chlorinated alkanes, fluorinated alkanes, chlorofluorocarbons and the like), branched paraffinic solvent blends such as Isopar™ G, Isopar™ H, Isopar™ K, and Isopar™ L (available from Exxon Corporation, NJ), aliphatic hydrocarbon solvent blends such as Norpar™ 12 and Norpar™ 13 (available from Exxon Corporation, NJ), and blends of these solvents. Particularly preferred reaction solvents have a Hildebrand solubility parameter of from about 13 to about 15 $MPa^{1/2}$. Preferred reaction solvents are relatively low boiling solvents (i.e having a boiling point preferably below about 250° C., more preferably below about 200° C., and most preferably below about 150° C.), which is particularly advantageous for stripping residual monomer from the graft copolymer material and for drying of the toner particles prior to redispersion. The reaction liquid chosen for the polymerization reaction should be carefully selected so that the same liquid may be used as the carrier liquid for the redispersed liquid toner. This is beneficial because the dried toner is easily redispersible in the original solvent. Therefore, because the carrier liquid/reaction solvent will be used in an end product, the flashpoint of the carrier liquid/reaction solvent, determined using ASTM test method D3828 method A, is preferably above about 60° C. and more preferably above about 93° C.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

The weight average molecular weight of the amphipathic copolymer of the present invention can vary over a wide range, and can impact imaging performance. The polydispersity of the copolymer also can impact imaging and transfer performance of the resultant liquid toner material. Because of the difficulty of measuring molecular weight for an amphipathic copolymer, the particle size of the dispersed copolymer (organosol) can instead be correlated to imaging and transfer performance of the resultant liquid toner material. Generally, the volume mean particle diameter ($D_v$) of the dispersed graft copolymer particles, determined by laser diffraction particle size measurement, should be in the range 1-100 microns, more preferably 5-75 microns, and most preferably 10-50 microns.

In addition, a correlation exists between the molecular weight of the solvatable or soluble S material portion of the graft copolymer, and the imaging and transfer performance of the resultant toner. Generally, the S material portion of the copolymer has a weight average molecular weight in the range of 1000 to about 1,000,000 Daltons, preferably 5000 to 400,000 Daltons, more preferably 50,000 to 300,000 Daltons. It is also generally desirable to maintain the polydispersity (the ratio of the weight-average molecular weight to the number average molecular weight) of the S material portion of the copolymer below 15, more preferably below 5, most preferably below 2.5. It is a distinct advantage of the present invention that copolymer particles with such lower polydispersity characteristics for the S material portion are easily made in accordance with the practices described herein.

The relative amounts of S and D material portions in a copolymer can impact the solvating and dispersibility characteristics of these portions. For instance, if too little of the S material portion(s) are present, the copolymer can have too little stabilizing effect to sterically-stabilize the organosol with respect to aggregation as might be desired. If too little of the D material portion(s) are present, the small amount of D material can be too soluble in the reaction solvent or the carrier liquid such that there can be insufficient driving force to form a distinct particulate, dispersed phase in the reaction solvent or the carrier liquid. The presence of both a solvated and dispersed phase helps the ingredients of particles self assemble in situ with exceptional uniformity among separate particles. Balancing these concerns, the preferred weight ratio of D material to S material is in the range of 1/20 to 20/1, preferably 1/1 to 15/1, more preferably 2/1 to 10/1, and most preferably 4/1 to 8/1.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1/T_{g1} + w_2/T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54-55 (1992).

In the practice of the present invention, calculated values of $T_g$ for the D or S material portion of the copolymer were determined using the Fox equation above, although the measured $T_g$ of the copolymer as a whole can be determined experimentally using e.g., differential scanning calorimetry. The glass transition temperatures ($T_g$'s) of the S and D material portions can vary over a wide range and can be independently selected to enhance manufacturability and/or performance of the resulting liquid toner particles. The $T_g$'s of the S and D material portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

For copolymers useful in liquid toner applications, the copolymer $T_g$ preferably should not be too low or else receptors printed with the toner can experience undue blocking. Conversely, the minimum fusing temperature required to soften or melt the toner particles sufficient for them to adhere to the final image receptor will increase as the copolymer $T_g$ increases. Consequently, it is preferred that the $T_g$ of the copolymer be far enough above the expected maximum storage temperature of a printed receptor so as to avoid blocking, yet not so high as to require fusing temperatures approaching the temperatures at which the final image receptor can be damaged, e.g. approaching the autoignition temperature of paper used as the final image receptor. Desirably, therefore, the copolymer has a $T_g$ of 0°-100° C., more preferably 20°-90° C., most preferably 40°-80° C.

For copolymers in which the D material portion comprises a major portion of the copolymer, the $T_g$ of the D material portion will dominate the $T_g$ of the copolymer as a whole. For such copolymers useful in liquid toner applications, it is preferred that the $T_g$ of the D material portion fall in the range of 30°-105° C., more preferably 40°-95° C., most preferably 60°-85° C., since the S material portion will generally exhibit a lower $T_g$ than the D material portion, and a higher $T_g$ D material portion is therefore desirable to offset the $T_g$ lowering effect of the S material portion, which can be solvatable. Blocking with respect to the S material portion material is not as significant an issue inasmuch as preferred copolymers comprise a majority of the D material portion material. Consequently, the $T_g$ of the D material portion material will dominate the effective $T_g$ of the copolymer as a whole. However, if the $T_g$ of the S material portion is too low, then the particles might tend to aggregate. On the other hand, if the $T_g$ is too high, then the requisite fusing temperature can be too high. Balancing these concerns, the S material portion material is preferably formulated to have a $T_g$ of at least 0° C., preferably at least 20° C., more preferably at least 40° C.

It is understood that the requirements imposed on the self-fixing characteristics of a liquid toner will depend to a great extent upon the nature of the imaging process. For example, rapid self-fixing of the toner to form a cohesive film may not be required or even desired in an electrographic imaging process if the image is not subsequently transferred to a final receptor, or if the transfer is effected by means (e.g. electrostatic transfer) not requiring a film formed toner on a temporary image receptor (e.g. a photoreceptor). However, where rapid self-fixing of the toner is desired, the calculated glass transition temperature of the D material portion is preferably formulated to be less than 0° C., more preferably between −25° C. and 0° C.

Similarly, in multi-color (or multi-pass) electrostatic printing wherein a stylus is used to generate a latent electrostatic image directly upon a dielectric receptor that serves as the final toner receptor material, a rapidly self-fixing toner film can be undesirably removed in passing under the stylus. This head scraping can be reduced or eliminated by manipulating the effective glass transition temperature of the organosol. For liquid electrographic (electrostatic) toners, particularly liquid toners developed for use in direct electrostatic printing processes, the D material portion of the organosol is preferably provided with a sufficiently high $T_g$ such that the organosol exhibits an effective glass transition temperature of from about 15° C. to about 55° C., and the D material portion exhibits a $T_g$ calculated using the Fox equation, of about 30-55° C.

In one aspect of the present invention, toner particles are provided that are particularly suitable for electrophotographic processes wherein the transfer of the image from the surface of a photoconductor to an intermediate transfer material or directly to a print medium is carried out without film formation on the photoconductor. In this aspect, the D material preferably has a $T_g$ of at least about 55° C., and more preferably at least about 65° C.

A wide variety of one or more different monomeric, oligomeric and/or polymeric materials can be independently incorporated into the S and D material portions, as desired. Representative examples of suitable materials include free radically polymerized material (also referred to as vinyl copolymers or (meth) acrylic copolymers in some embodiments), polyurethanes, polyester, epoxy, polyamide, polyimide, polysiloxane, fluoropolymer, polysulfone, combinations of these, and the like. Preferred S and D material portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case can be) that participate in polymerization reactions via a free radical mechanism. Representative examples of such functionality includes (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth)acryl", as used herein, encompasses acryl and/or methacryl.

Free radically polymerizable monomers, oligomers, and/or polymers are advantageously used to form the copolymer in that so many different types are commercially available and can be selected with a wide variety of desired characteristics that help provide one or more desired performance characteristics. Free radically polymerizable monomers, oligomers, and/or monomers suitable in the practice of the present invention can include one or more free radically polymerizable moieties.

Preferred monomers used to form the amphipathic copolymers as described herein are $C_1$ to $C_{24}$ alkyl esters of acrylic acid and methacrylic acid. Representative examples of monofunctional, free radically polymerizable monomers include styrene, alpha-methylstyrene, substituted styrene, vinyl esters, vinyl ethers, N-vinyl-2-pyrrolidone, (meth) acrylamide, vinyl naphthalene, alkylated vinyl naphthalenes, alkoxy vinyl naphthalenes, N-substituted (meth)acrylamide, octyl (meth)acrylate, nonylphenol ethoxylate (meth) acrylate, N-vinyl pyrrolidone, isononyl (meth)acrylate, isobornyl (meth)acrylate, 2-(2-ethoxyethoxy)ethyl (meth) acrylate, 2-ethylhexyl (meth)acrylate, beta-carboxyethyl (meth)acrylate, isobutyl (meth)acrylate, cycloaliphatic epoxide, alpha-epoxide, 2-hydroxyethyl (meth)acrylate, (meth)acrylonitrile, maleic anhydride, itaconic acid, isodecyl (meth)acrylate, lauryl (dodecyl) (meth)acrylate, stearyl (octadecyl) (meth)acrylate, behenyl (meth)acrylate, n-butyl (meth)acrylate, methyl (meth)acrylate, ethyl (meth)acrylate, hexyl (meth)acrylate, (meth)acrylic acid, N-vinylcaprolactam, stearyl (meth)acrylate, hydroxy functional caprolactone ester (meth)acrylate, isooctyl (meth)acrylate, hydroxyethyl (meth)acrylate, hydroxymethyl (meth)acrylate, hydroxypropyl (meth)acrylate, hydroxyisopropyl (meth)acrylate, hydroxybutyl (meth)acrylate, hydroxyisobutyl (meth)acrylate, tetrahydrofurfuryl (meth)acrylate, isobornyl (meth) acrylate, glycidyl (meth)acrylate vinyl acetate, combinations of these, and the like.

Preferred copolymers of the present invention can be formulated with one or more radiation curable monomers or combinations thereof that help the free radically polymerizable compositions and/or resultant cured compositions to satisfy one or more desirable performance criteria. For example, in order to promote hardness and abrasion resistance, a formulator can incorporate one or more free radically polymerizable monomer(s) (hereinafter "high $T_g$ component") whose presence causes the polymerized material, or a portion thereof, to have a higher glass transition temperature, $T_g$, as compared to an otherwise identical material lacking such high $T_g$ component. Preferred monomeric constituents of the high $T_g$ component generally include monomers whose homopolymers have a $T_g$ of at least about 50° C., preferably at least about 60° C., and more preferably at least about 75° C. in the cured state. The advantages of incorporating such monomers into the copolymer are further described in assignee's co-pending U.S. Patent Application filed in the name of Qian et al., U.S. Ser. No. 10/612,765, filed on Jun. 30, 2003, entitled ORGANOSOL INCLUDING HIGH $T_g$ AMPHIPATHIC COPOLYMERIC BINDER AND LIQUID TONER FOR ELECTROPHOTOGRAPHIC APPLICATIONS; and Qian et al., U.S. Ser. No. 10/612,533, filed on Jun. 30, 2003, entitled ORGANOSOL INCLUDING AMPHIPATHIC COPOLYMERIC BINDER MADE WITH SOLUBLE HIGH $T_g$ MONOMER AND LIQUID TONERS FOR ELECTROPHOTOGRAPHIC APPLICATIONS for liquid toner compositions, which are hereby incorporated by reference.

In a preferred embodiment of the present invention, the S material portion comprises radiation curable monomers that have relatively high $T_g$ characteristics. Preferably, such monomers comprise at least one radiation curable (meth) acrylate moiety and at least one nonaromatic, alicyclic and/or nonaromatic heterocyclic moiety. Examples of preferred monomers that can be incorporated into the S material portion comprise isobornyl (meth)acrylate; 1,6-Hexanediol di(meth)acrylate; trimethyl cyclohexyl methacrylate; t-butyl methacrylate; and n-butyl methacrylate. Combinations of high $T_g$ components for use in the S material portion are specifically contemplated, together with anchor grafting groups such as provided by use of HEMA subsequently reacted with TMI.

In certain preferred embodiments, polymerizable crystallizable compounds, e.g. crystalline monomer(s) are incorporated into the copolymer by chemical bonding to the copolymer. The term "crystalline monomer" refers to a monomer whose homopolymeric analog is capable of independently and reversibly crystallizing at or above room temperature (e.g., 22° C.). The term "chemical bonding" refers to a covalent bond or other chemical link between the polymerizable crystallizable compound and one or more of the other constituents of the copolymer. The advantages of incorporating PCC's into the copolymer are further described in assignee's co-pending U.S. Patent Application filed in the name of Qian et al., U.S. Ser. No. 10/612,534, filed on Jun. 30, 2003, entitled ORGANOSOL LIQUID TONER INCLUDING AMPHIPATHIC COPOLYMERIC BINDER HAVING CRYSTALLINE COMPONENT.

In these embodiments, the resulting toner particles can exhibit improved blocking resistance between printed receptors and reduced offset during fusing. If used, one or more of these crystalline monomers can be incorporated into the S and/or D material, but preferably is incorporated into the D material. Suitable crystalline monomers include alkyl (meth)acrylates where the alkyl chain contains more than 13 carbon atoms (e.g. tetradecyl(meth)acrylate, pentadecyl (meth)acrylate, hexadecyl(meth)acrylate, heptadecyl(meth) acrylate, octadecyl(meth)acrylate, etc). Other suitable crystalline monomers whose homopolymers have melting points above 22° C. include aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; polymerizable natural waxes with melting points above 22° C., polymerizable synthetic waxes with melting points above 22° C., and other similar type materials known to those skilled in the art. As described herein, incorporation of crystalline monomers in the copolymer provides surprising benefits to the resulting liquid toner particles.

Nitrile functionality can be advantageously incorporated into the copolymer for a variety of reasons, including improved durability, enhanced compatibility with visual enhancement additive(s), e.g., colorant particles, and the like. In order to provide a copolymer having pendant nitrile groups, one or more nitrile functional monomers can be used. Representative examples of such monomers include (meth)acrylonitrile, β-cyanoethyl-(meth)acrylate, 2-cyanoethoxyethyl (meth)acrylate, p-cyanostyrene, p-(cyanomethyl)styrene, N-vinylpyrrolidinone, and the like.

In order to provide a copolymer having pendant hydroxyl groups, one or more hydroxyl functional monomers can be used. Pendant hydroxyl groups of the copolymer not only facilitate dispersion and interaction with the pigments in the formulation, but also promote solubility, cure, reactivity with other reactants, and compatibility with other reactants. The hydroxyl groups can be primary, secondary, or tertiary, although primary and secondary hydroxyl groups are preferred. When used, hydroxy functional monomers constitute from about 0.5 to 30, more preferably 1 to about 25 weight percent of the monomers used to formulate the copolymer, subject to preferred weight ranges for graft copolymers noted below.

Representative examples of suitable hydroxyl functional monomers include an ester of an α,β-unsaturated carboxylic acid with a diol, e.g., 2-hydroxyethyl (meth)acrylate, or 2-hydroxypropyl (meth)acrylate; 1,3-dihydroxypropyl-2-(meth)acrylate; 2,3-dihydroxypropyl-1-(meth)acrylate; an adduct of an α,β-unsaturated carboxylic acid with caprolactone; an alkanol vinyl ether such as 2-hydroxyethyl vinyl ether; 4-vinylbenzyl alcohol; allyl alcohol; p-methylol styrene; or the like.

Multifunctional free radically reactive materials can also used to enhance one or more properties of the resultant toner particles, including crosslink density, hardness, tackiness, mar resistance, or the like. Examples of such higher functional, monomers include ethylene glycol di(meth)acrylate, hexanediol di(meth)acrylate, triethylene glycol di(meth) acrylate, tetraethylene glycol di(meth)acrylate, trimethylolpropane tri(meth)acrylate, ethoxylated trimethylolpropane tri(meth)acrylate, glycerol tri(meth)acrylate, pentaerythritol tri(meth)acrylate, pentaerythritol tetra(meth)acrylate, and neopentyl glycol di(meth)acrylate, divinyl benzene, combinations of these, and the like.

Suitable free radically reactive oligomer and/or polymeric materials for use in the present invention include, but are not limited to, (meth)acrylated urethanes (i.e., urethane (meth) acrylates), (meth)acrylated epoxies (i.e., epoxy (meth)acrylates), (meth)acrylated polyesters (i.e., polyester (meth)acrylates), (meth)acrylated (meth)acrylics, (meth)acrylated silicones, (meth)acrylated polyethers (i.e., polyether (meth) acrylates), vinyl (meth)acrylates, and (meth)acrylated oils.

Copolymers of the present invention can be prepared by free-radical polymerization methods known in the art, including but not limited to bulk, solution, and dispersion polymerization methods. The resultant copolymers can have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S material portion or D material portion materials, as the case can be, can be incorporated into the arms and/or the backbone.

Any number of reactions known to those skilled in the art can be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K. E. J. Barrett, ed., (John Wiley; New York, 1975) pp. 79-106, also incorporated herein by reference.

Representative examples of grafting methods also can use an anchoring group. The function of the anchoring group is to provide a covalently bonded link between the core part of the copolymer (the D material) and the soluble shell component (the S material). Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone. Preferred S material portions comprise a plurality of anchoring groups, thereby providing an amphipathic copolymer having a plurality of links between the individual S material portions and the D material portions.

The preferred methodology described above accomplishes grafting via attaching an ethylenically-unsaturated isocyanate (e.g., dimethyl-m-isopropenyl benzylisocyanate, TMI, available from CYTEC Industries, West Paterson, N.J.; or isocyanatoethyl methacrylate, IEM) to hydroxyl groups in order to provide free radically reactive anchoring groups.

A preferred method of forming a graft copolymer of the present invention involves three reaction steps that are carried out in a suitable substantially nonaqueous reaction solvent in which resultant S material is soluble while D material is dispersed or insoluble.

In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. meta-isopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S material portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer. For instance, using the Hildebrand solubility parameters in Table 1, monomers such as e.g. methyl (meth)acrylate, ethyl (meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially nonaqueous reaction solvent comprising less than about 10% aromatic components for the organosol. At this stage, it is believed that the copolymer tends to exist in the reaction solvent as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the reaction solvent.

Before further processing, the copolymer particles can remain in the reaction solvent. Alternatively, the particles can be transferred in any suitable way into fresh solvent that is the same or different so long as the copolymer has solvated and dispersed phases in the fresh solvent. In either case, the resulting organosol is then converted into toner particles by mixing the or milling organosol with appropriate additives, such as at least one visual enhancement additive. Optionally, one or more other desired ingredients also can be mixed or milled into the organosol before and/or after combination with the visual enhancement particles. During such combination, it is believed that ingredients comprising the visual enhancement additive and the copolymer will tend to self-assemble into composite particles having a structure wherein the dispersed phase portions generally tend to associate with the visual enhancement additive particles (for example, by physically and/or chemically interacting with the surface of the particles), while the solvated phase portions help promote dispersion in the carrier. In addition to the visual enhancement additive, other additives optionally can be formulated into the liquid toner composition.

The visual enhancement additive(s) generally may include any one or more fluid and/or particulate materials that provide a desired visual effect when toner particles incorporating such materials are printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive coated on binder particles may vary over a wide range. In representative embodiments, a suitable weight ratio of copolymer to visual enhancement additive is from 1/1 to 20/1, preferably from 2/1 to 10/1 and most preferably from 4/1 to 8/1.

Useful colorants are well known in the art and include materials listed in the Colour Index, as published by the Society of Dyers and Colourists (Bradford, England), including dyes, stains, and pigments. Preferred colorants are pigments which may be combined with ingredients comprising the binder polymer to form dry toner particles with structure as described herein, are at least nominally insoluble in and nonreactive with the carrier liquid, and are useful and effective in making visible the latent electrostatic image. It is understood that the visual enhancement additive(s) may also interact with each other physically and/or chemically, forming aggregations and/or agglomerates of visual enhancement additives that also interact with the binder polymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), isoindoline yellow (C.I. Pigment Yellow 138), azo red (C.I. Pigment Red 3, 17, 22, 23, 38, 48:1, 48:2, 52:1, and 52:179), quinacridone magenta (C.I. Pigment Red 122, 202 and 209), laked rhodamine magenta (C.I. Pigment Red 81:1, 81:2, 81:3, and 81:4), and black pigments such as finely divided carbon (Cabot Monarch 120, Cabot Regal 300R, Cabot Regal 350R, Vulcan X72, and Aztech EK 8200), and the like.

Charge directors can be used in any liquid toner process, and particularly can be used for electrostatic transfer of toner particles or transfer assist materials. The charge director typically provides the desired uniform charge polarity of the toner particles. In other words, the charge director acts to impart an electrical charge of selected polarity onto the toner particles as dispersed in the carrier liquid. Preferably, the charge director is applied to the outside of the binder particle in the reaction solvent, in which case the charge director is preferably soluble in the reaction solvent. Alternatively or additionally, the charge director can be incorporated into the toner particles using a wide variety of methods, such as copolymerizing a suitable monomer with the other monomers to form a copolymer, chemically reacting the charge director with the toner particle, chemically or physically adsorbing the charge director onto the toner particle, or chelating the charge director to a functional group incorporated into the toner particle.

The preferred amount of charge director or charge control additive for a given toner formulation will depend upon a number of factors, including the composition of the polymer binder. Preferred polymeric binders are graft amphipathic copolymers. The preferred amount of charge director or charge control additive when using an organosol binder particle further depends on the composition of the S material portion of the graft copolymer, the composition of the organosol, the molecular weight of the organosol, the particle size of the organosol, the core/shell ratio of the graft copolymer, the pigment used in making the toner, and the ratio of organosol to pigment. In addition, preferred amounts of charge director or charge control additive will also depend upon the nature of the electrophotographic imaging process, particularly the design of the developing hardware and photoreceptive element. It is understood, however, that the level of charge director or charge control additive can be adjusted based on a variety of parameters to achieve the desired results for a particular application.

Any number of negative charge directors such as those described in the art can be used in the liquid toners of the present invention in order to impart a negative electrical charge onto the toner particles. For example, the charge director can be lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt (e.g., Na) of a phosphoglyceride A preferred example of such a charge director is Emphos™ D70-30C, Witco Chemical Corp., New York. N.Y., which is a sodium salt of phosphated mono- and diglycerides.

Likewise, any number of positive charge directors such as those described in the art can be used in the liquid toners of the present invention in order to impart a positive electrical charge onto the toner particles. For example, the charge director can be introduced in the form of metal salts consisting of polyvalent metal ions and organic anions as the counterion. Suitable metal ions include Ba(II), Ca(II), Mn(II), Zn(II), Zr(IV), Cu(II), Al(III), Cr(III), Fe(II), Fe(III), Sb(III), Bi(III) Co(II), La(III), Pb(II), Mg(II), Mo(III), Ni(II), Ag(I), Sr(II), Sn(IV), V(V), Y(III) and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acid, and the like. Preferred positive charge directors are the metallic carboxylates (soaps), such as those described in U.S. Pat. No. 3,411,936. A particularly preferred positive charge director is zirconium 2-ethyl hexanoate.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and is seen in the low relationship between current density and toner deposited during development. Low conductivities indicate little or no charging of the toner particles and lead to very low development rates. The use of charge directors matched to adsorption sites on the toner particles is a common practice to ensure sufficient charge associates with each toner particle.

Other additives can also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50.0 microns, more preferably in the range of about 1.5 to about 10 microns, most preferably in the range of about 3 to about 5 microns.

The thus created toner particles are dried to provide a dry toner particle composition. For purposes of the present invention, the term "dry" does not mean that the dry toner is totally free of any liquid constituents, but connotes that the toner particles do not contain any significant amount of solvent, e.g., typically less than 20 weight percent solvent, more preferably less than about 10 weight percent solvent, and most preferably less than 5 weight percent solvent. The toner particles can be dried by any desired process, such as, for example, by filtration and subsequent drying of the filtrate by evaporation, optionally assisted with heating. Preferably, this process is carried out in a manner that minimizes agglomeration and/or aggregation of the toner particles into one or more large masses. If such masses form, they can optionally be pulverized or otherwise comminuted and/or classified in order to obtain dry toner particles of an appropriate size.

Alternative drying configurations can be used, such as by coating the toner dispersed in the reaction solvent onto a drying substrate, such as a moving web. In a preferred embodiment, the coating apparatus includes a coating station at which the liquid toner is coated onto surface of a moving web wherein the charged toner particles are coated on the web by an electrically biased deposition roller. A preferred system for carrying out this coating process is described copending U.S. Utility Patent Application Ser. No. 10/881,637, filed Jun. 30, 2004, titled "DRYING PROCESS FOR TONER PARTICLES USEFUL IN ELECTROGRAPHY." An alternative preferred system comprises using extrusion techniques to help transfer toner particles, which may or may not be charged at this stage, from a reaction solvent onto a substrate surface. A relatively thin coating of extruded particles is formed on the surface as a consequence. Because the resultant coating has a relatively large drying surface area per gram of particle incorporated into the coating, drying can occur relatively quickly under moderate temperature and pressure conditions. A preferred system for carrying out this drying process is described in copending U.S. Utility Patent Application Ser. No. 10/880,799, filed Jun. 30, 2004, titled "EXTRUSION DRYING PROCESS FOR TONER PARTICLES USEFUL IN ELECTROGRAPHY."

The coated toner particles can optionally be squeezed to eliminate excess reaction solvent by passing the coated web between at least one pair of calendaring rollers. The calendaring rollers preferably can be provided with a slight bias that is higher than the deposition roller applied to keep the charged toner particles from transferring off the moving web. Downstream from the coating station components, the moving web preferably passes through a drying station, such as an oven, in order to remove the remaining reaction solvent to the desired degree. Although drying temperatures may vary, drying preferably occurs at a web temperature that is at least about 5° C. and more preferably at least about 10°

C., below the effective $T_g$ of the toner particles. After emerging from oven, the dried toner particles on the moving web are preferably passed through a deionizer unit to help eliminate triboelectric charging, and are then gently removed from the moving web (such as by scraping with a plastic blade) and deposited into a collection device at a particle removal station.

The resulting dry toner particle composition is readily redispersed in a carrier liquid. While not being bound by theory, it is believed that the drying process removes undesired impurities and charged component, such as undesired counterions, that adversely affect the viscosity, stability and imaging properties of the toner particles when provided in a liquid toner composition. Additionally, the dry toner particles are readily and stably redispersed in the carrier liquid. While not being bound by theory, it is believed that this redispersibility is due to the amphipathic nature of the binder polymer, in combination with the elimination of undesired components in the drying process.

In a preferred embodiment of the present invention, a "just in time" or "on demand" supply process is provided using the liquid toner process described herein, wherein the dry toner particle composition is stored at or near the manufacturing site, and redispersed in a carrier liquid as described herein only upon receipt of an order for liquid toner from a customer of the manufacturer. In another embodiment a supply process is provided wherein the dry toner particle composition is stored at or near the manufacturing site, and redispersed in a carrier liquid as described herein only upon projection of near term (i.e. within 5 days) or imminent need of shipping of liquid toner from the manufacturing site. In both of these embodiments, advantages are realized in storage stability, volume of storage required, reduced flammability of the stored intermediate material, and the ability to easily premix dry toners to average out batch variations, thereby providing superior lot-to-lot consistency.

In another embodiment of the present invention, the dry toner particle composition is transported in the dry state to a location remote from the manufacturing site prior to redispersion in a carrier liquid. Thus, the dry toner particle composition can be packaged in refill quantities and containers for shipping to a distributor or the ultimate customer for redispersion by a non-manufacturing party in location closer to the site of ultimate use, or at the site of ultimate use of the toner. Shipping of only the dry toner phase of the present toner composition provides advantages in reduction of weight of product to be shipped as a final product, transport and storage condition advantages and reduced flammability hazards.

In yet another embodiment, the dry toner particle composition can be provided together with a carrier liquid as described herein in a two-part kit, with instructions for dispersion of the dry toner with the carrier liquid at or near the site of use of the toner. In a preferred embodiment, the dry toner particle composition and the carrier liquid are provided in containers that are designed to cooperatively work together to facilitate redispersion of the dry toner particle composition in the carrier liquid. For example, the dry toner particle composition can be packaged in a container specially designed to fit together with the container for the carrier liquid. Alternatively, the dry toner particle composition can be packaged in a container specially designed to provide the appropriate quantity of dry toner particle composition for the predetermined quantity of carrier liquid as provided in the kit.

Finally, the dry toner particle composition is redispersed in a carrier liquid that comprises less than about 10% aromatic components by weight and has a Kauri-Butanol number less than about 30 mL, to form a redispersed liquid electrographic toner composition. As noted above, this redispersion can be carried out in the primary manufacturing facility, in a facility that is remote from the manufacturing facility or at the site of the imaging operation. In a preferred aspect of the present invention, the redispersion is carried out by a mechanism that is a part of the imaging device itself. Preferred systems that provide both redispersion and imaging are described in copending U.S. Utility patent application Ser. No. 10/978,671, filed on even date with this application, titled "PRINTING SYSTEMS AND METHODS FOR LIQUID TONERS COMPRISING DISPERSED TONER PARTICLES."

The toner compositions as described herein are highly useful in electrophotographic and electrographic processes. In electrography, a latent image is typically formed by (1) placing a charge image onto the dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. Images formed by the present invention can be of a single color or a plurality of colors. Multicolor images can be prepared by repetition of the charging and toner application steps.

In electrophotography, the electrostatic image is typically formed on a drum or belt coated with a photoreceptive element by (1) uniformly charging the photoreceptive element with an applied voltage, (2) exposing and discharging portions of the photoreceptive element with a radiation source to form a latent image, (3) applying a toner to the latent image to form a toned image, and (4) transferring the toned image through one or more steps to a final receptor sheet. In some applications, it is sometimes desirable to fix the toned image using a heated pressure roller or other fixing methods known in the art.

While the electrostatic charge of either the toner particles or photoreceptive element can be either positive or negative, electrophotography as employed in the present invention is preferably carried out by dissipating charge on a positively charged photoreceptive element. A positively-charged toner is then applied to the regions in which the positive charge was dissipated using a liquid toner development technique.

The substrate for receiving the image from the photoreceptive element can be any commonly used receptor material, such as paper, coated paper, polymeric films and primed or coated polymeric films. Polymeric films include polyesters and coated polyesters, polyolefins such as polyethylene or polypropylene, plasticized and compounded polyvinyl chloride (PVC), acrylics, polyurethanes, polyethylene/acrylic acid copolymer, and polyvinyl butyrals. The polymer film can be coated or primed, e.g. to promote toner adhesion.

In electrophotographic processes, the toner composition preferably is provided at a solids content of about 1-30% (w/w). In electrostatic processes, the toner composition preferably is provided at a solids content of 3-15% (w/w).

These and other aspects of the present invention are demonstrated in the illustrative examples that follow.

EXAMPLES

Glossary of Chemical Abbreviations

The following abbreviations are used in the examples which follow:

AAD: Acrylamide (Sigma-Aldrich, Steiheim, Germany)
DBTDL: Dibutyl tin dilaurate (a catalyst available from Aldrich Chemical Co., Milwaukee, WI)
EMA: Ethyl methacrylate (available from Aldrich Chemical Co., Milwaukee, WI)
HEMA: 2-Hydroxyethyl methacrylate (available from Aldrich Chemical Co., Milwaukee, WI)
TCHMA: 3,3,5-Trimethyl cyclohexyl methacrylate (available from Ciba Specialty Chemical Co., Suffolk, Virginia)
TMI: Dimethyl-m-isopropenyl benzyl isocyanate (available from CYTEC Industries, West Paterson, NJ)
V-601: Dimethyl 2,2'-azobisisobutyrate (an initiator available as V-601 from WAKO Chemicals U.S.A., Richmond, VA)
Zirconium HEX-CEM: a metal soap--zirconium tetraoctoate (available from OMG Chemical Company, Cleveland, OH)

Test Methods

Percent Solids/Dryness

In the following toner composition examples, percent solids of the graft stabilizer solutions and the organosol, the liquid toner dispersions, and the percent dryness of dry toner were determined thermo-gravimetrically by drying in an aluminum weighing pan an originally-weighed sample at 160° C. for two hours for graft stabilizer and three hours for organosol or liquid toner dispersions, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

Molecular Weight

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using a Hewlett Packard Series II 1190 Liquid Chromatograph made by Agilent Industries (formerly Hewlett Packard, Palo Alto, Calif.) (using software HPLC Chemstation Rev A.02.02 1991-1993 395). Tetrahydrofuran was used as the carrier solvent. The three columns used in the Liquid Chromatograph were Jordi Gel Columns (DVB 1000A, and DVB10000A and DVB100000A; Jordi Associates, Inc., Bellingham, Mass.). Absolute weight average molecular weight were determined using a Dawn DSP-F light scattering detector (software by Astra v.4.73.04 1994-1999) (Wyatt Technology Corp., Santa Barbara, Calif.), while polydispersity was evaluated by ratioing the measured weight average molecular weight to a value of number average molecular weight determined with an Optilab DSP Interferometric refractometer detector (Wyatt Technology Corp., Santa Barbara, Calif.).

Particle Size

The organosol and liquid toner particle size distributions were determined using a Horiba LA-920 laser diffraction particle size analyzer (commercially obtained from Horiba Instruments, Inc, Irvine, Calif.) using Norpar™ 12 fluid that contains 0.1% Aerosol OT (dioctyl sodium sulfosuccinate, sodium salt, Fisher Scientific, Fairlawn, N.J.) surfactant.

The dry toner particle size distributions were determined using a Horiba LA-900 laser diffraction particle size analyzer (commercially obtained from Horiba Instruments, Inc, Irvine, Calif.) using de-ionized water that contains 0.1% Triton X-100 surfactant (available from Union Carbide Chemicals and Plastics, Inc., Danbury, Conn.).

Prior to the measurements, samples were pre-diluted to approximately 1% by the solvent (i.e., Norpar 12™ or water). Liquid toner samples were sonicated for 6 minutes in a Probe VirSonic sonicator (Model-550 by The VirTis Company, Inc., Gardiner, N.Y.). Dry toner samples were sonicated in water for 20 seconds using a Direct Tip Probe VirSonic sonicator (Model-600 by The VirTis Company, Inc., Gardiner, N.Y.). In both procedures, the samples were diluted by approximately 1/500 by volume during the measurements. Sonication on the Horiba LA-920 was operated at 150 watts and 20 kHz for one minute prior to data collection. The particle size was expressed on a number-average basis ($D_n$) in order to provide an indication of the fundamental (primary) particle size of the particles or was expressed on a volume-average basis ($D_v$) in order to provide an indication of the coalesced primary particle size of the agglomerated primary particles.

Conductivity

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 10° C. for 1 hour at 7,500 rpm (6,110 relative centrifugal force) in a Jouan MR1822 centrifuge (Winchester, Va.). The supernatant liquid was then carefully decanted, and the conductivity of this liquid was measured using a Scientifica Model 627 conductance meter. The percentage of free phase conductivity relative to the bulk toner conductivity was then determined as 100% ($k_f/k_b$).

Mobility

Toner particle electrophoretic mobility (dynamic mobility) was measured using a Matec MBS-8000 Electrokinetic Sonic Amplitude Analyzer (Matec Applied Sciences, Inc., Hopkinton, Mass.). Unlike electrokinetic measurements based upon microelectrophoresis, the MBS-8000 instrument has the advantage of requiring no dilution of the toner sample in order to obtain the mobility value. Thus, it was possible to measure toner particle dynamic mobility at solids concentrations actually preferred in printing. The MBS-8000 measures the response of charged particles to high frequency (1.2 MHz) alternating (AC) electric fields. In a high frequency AC electric field, the relative motion between charged toner particles and the surrounding dispersion medium (including counter-ions) generates an ultrasonic wave at the same frequency of the applied electric field. The amplitude of this ultrasonic wave at 1.2 MHz can be measured using a piezoelectric quartz transducer; this electrokinetic sonic amplitude (ESA) is directly proportional to the low field AC electrophoretic mobility of the particles. The particle zeta potential can then be computed by the instrument from the measured dynamic mobility and the known toner particle size, liquid dispersant viscosity, and liquid dielectric constant.

Q/M of Liquid Toner

The charge per mass measurement (Q/M) of the liquid toner was measured using an apparatus that consists of a conductive metal plate, a glass plate coated with Indium Tin Oxide (ITO), a high voltage power supply, an electrometer, and a personal computer (PC) for data acquisition. A 1% solution of toner was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times a second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles may be made to migrate to that plate.

The ITO coated glass plate was removed from the apparatus and placed in an oven for approximately 1 hour at 160° C. to dry the plated toner completely. After drying, the ITO coated glass plate containing the dried toner film was weighed. The toner was then removed from the ITO coated glass plate using a cloth wipe impregnated with Norpar™ 12, and the clean ITO glass plate was weighed again. The difference in mass between the dry toner coated glass plate and the clean glass plate is taken as the mass of toner particles (m) deposited during the 20 second plating time. The electrical current values were used to obtain the total charge carried by the toner particles (Q) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated toner mass.

Viscosity

Viscosity of the liquid toners was measured using a Brookfield viscometer (Model LVT, Brookfield Engineering Laboratories, Inc, Stoughton, Mass.).

Toner Drying Procedure

For some examples below, dry toner is prepared from a liquid toner using a Lab Coater (available from T.H. Dixon & Co. Ltd., Hertfordshire, England) equipped with a SENTRY™ (available from SIMCO Industrial Static Control, Bloomington, Minn.) ionizing air blower. The dry toner preparation method summarized below is disclosed in co-pending U.S. Utility Patent Application Ser. No. 10/881,637, filed Jun. 30, 2004, which is hereby incorporated by reference.

The coating apparatus includes coating station at which the liquid toner is coated onto surface of a moving web. The coating station includes a reservoir containing the charged toner particles dispersed in the liquid carrier (liquid toner). The coating station also includes an electrically biased deposition roller and calendar rollers. The deposition roller is at least partially submerged in the reservoir containing the liquid toner and may be made to contact or form a gapped nip with the moving web. In this apparatus, the deposition roller has a diameter of 0.89 inches (2.3 cm) and operates at a speed of 60 rpm (corresponding to a surface speed of 2.8 inches/s (7.1 cm/s)) when the web is moving at a speed of 5 feet/min.

The moving web onto which the particles are coated is an aluminized polyester film composite in which an approximately 0.1 μm (1000 Å) thick layer of aluminum is formed on an approximately 4.0 mil thick (100 μm) polyester substrate.

The deposition roller is provided with an electrical bias and is rotating in the liquid toner reservoir. The movement of the biased (100V) deposition roller picks up the positively charged toner particles, which are electroplated onto the web, which is preferably grounded. Electrical charge characteristics of the toner particles are used to help plate the particles from the reservoir onto the moving web surface, where the transferred particles are more easily and effectively dried.

The plated liquid toner particles are squeezed to eliminate excess carrier liquid by passing the plated web between at least one pair of calendaring rollers. The calendaring rollers have a slight bias that is higher than the deposition roller applied to keep the charged toner particles from transferring off the moving web.

Downstream from the coating station components, the moving web passes through a drying station in order to remove the remaining liquid carrier to the desired degree. Most commonly, the toner particles may be deemed to be dry when the particles can contain less than about 20 weight percent, preferably less than about 10 weight percent.

The drying station is an oven having a generally linear path along which the moving web travels. The liquid toner particles to be dried travel a 20 foot long web path through an oven maintained at 50° C. at a web speed of 5 feet per minute. The average coating thickness of particles on web is about 2 to about 10 times the average particle diameter of the toner particles.

Although drying temperatures may vary, drying occurs at a temperature that is at least 5° C., below the effective $T_g$ of the liquid toner. The temperature of 50° C. is used for liquid toners that have a $T_g$ of 65° C.

After emerging from oven, the dried toner particles on the moving web are passed through a deionizer unit to help eliminate triboelectric charging. The dried toner particles are then gently scraped from the moving web by a plastic blade into a collection device at a particle removal station.

Print Testing

In the following examples, toner was printed onto final image receptors using the following methodology:

A light-sensitive temporary image receptor (organic photoreceptor or "OPC") was charged with a uniform positive charge of approximately 850 volts. The positively charged surface of the OPC was image-wise irradiated with a scanning infrared laser module in order to reduce the charge wherever the laser struck the surface. Typical charge-reduced values were between 50 volts and 100 volts.

A developer apparatus was then utilized to apply the toner particles to the OPC surface. The developer apparatus included the following elements: liquid toner, a conductive rubber developer roller in contact with the OPC, an insulative foam cleaning roller in contact with the developer roller surface, a conductive deposition roller, a conductive metering roll in contact with the developer roller, and an insulative foam toner pumping roller. The contact area between the developer roller and the OPC is referred to as the "developing nip." The conductive deposition roller was positioned with its roller axis parallel to the developer roller axis and its surface arranged to be approximately 150 microns from the surface of the developer roller, thereby forming a deposition gap.

During development, the toner pumping roller supplied liquid toner to the gap between the deposition roller and the developer roller. A toner film was initially plated to the developer roller surface by applying a voltage of approximately 600 volts to the developer roller and applying a voltage of approximately 800 volts to both the deposition and metering rollers. The 200 volt difference between the developer and deposition roller caused the positively charged toner particles to migrate in the deposition nip to the surface of the developer roller. The metering roller, which is biased to approximately 800 volts, removed excess liquid from the developer roller surface.

The surface of the developer roller now contained a uniformly thick layer of toner at approximately 25% (w/w) solids. As this toner layer passed through the developing nip, toner was transferred from the developer roller to the latent image areas. The approximate 500 volt difference between the developer roller and the latent image area caused the positively charged toner particles to develop to the OPC surface. At the exit of the developing nip, the OPC contained a toner image and the developer roller contained a negative of that toner image which was then cleaned from the developer roller surface by the rotating foam cleaning roller.

The developed image on the OPC was subsequently electrostatically transferred to an Intermediate Transfer Belt (ITB) with an electrical bias in the range of −800 to −2000 volts applied to a conductive rubber roller pressing the ITB to the OPC surface. Transfer to the final image receptor was accomplished with electrostatically-assisted offset transfer by forcibly applying a conductive, biased rubber transfer roller behind the image receptor, pressing the imaged ITB between the final image receptor and a grounded, conductive metal transfer backup roller. The transfer roller is typically biased in the range of −1200 to −3000 volts.

Optical Density and Color Purity

To measure optical density and color purity a GRETAG SPM 50 LT meter was used (available from Gretag Limited, CH-8105 Regensdort, Switzerland). The meter has several different functions through different modes of operations, selected through different buttons and switches. When a function (optical density, for example) is selected, the measuring orifice of the meter is placed on a background, or non-imaged portion of the imaged substrate in order to "zero" it. It is then placed on the designated color patch and the measurement button is activated. The optical densities of the various color components of the color patch (in this case, Cyan (C), Magenta (M), Yellow (Y), and Black (K)) will then displayed on the screen of the meter. The value of each specific component was used as the optical density for that component of the color patch. For instance, where a color patch was only cyan, the optical density reading was listed as simply the value on the screen for C.

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) designated TCHMA/HEMA-TMI (97/3-4.7% w/w) is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97/3-4.7//100% w/w) is made by copolymerizing the designated graft stabilizer (TCHMA/HEMA-TMI (97/3-4.7% w/w)) (S portion or shell) with the designated core monomer EMA (D portion or core, 100% EMA) at a specified ratio of D/S (core/shell) determined by the relative weights reported in the examples.

Graft Stabilizer Preparations

Example 1

A 190 liter reactor equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 88.45 kg of Norpar™12 fluid, by vacuum. The vacuum was then broken and a flow of 28.32 liter/hr of nitrogen applied and the agitation is started at 70 RPM. Next, 30.12 kg of TCHMA was added and the container rinsed with 1.22 kg of Norpar™12 fluid and 0.95 kg of 98% (w/w) HEMA was added and the container rinsed with 0.62 kg of Norpar™12 fluid. Finally, 0.39 kg of V-601 was added and the container rinsed with 0.091 kg of Norpar™12 fluid. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 28.32 liter/hr was applied. Agitation was resumed at 70 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.05 kg of 95% (w/w) DBTDL was added to the mixture using 0.62 kg of Norpar™12 fluid to rinse container, followed by 1.47 kg of TMI. The TMI was added continuously over the course of approximately 5 minutes while stirring the reaction mixture and the container was rinsed with 0.64 kg of Norpar™12 fluid. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 26.0% (w/w) using the thermogravimetric method described above. Subsequent determination of molecular weight was made using the GPC method described above; the copolymer had a $M_w$ of 289, 800 and $M_w/M_n$ of 2.44 based on two independent measurements. The glass transition temperature was measured to be 115° C. using DSC, as described above. The product is a copolymer of TCHMA and HEMA with a TMI grafting site and is designed herein as TCHMA/HEMA-TMI (97/3-4.7% w/w) and can be used to make an organosol.

Example 2

Example 2 was prepared using the method, materials, and apparatus described in Example 1. The cooled mixture was a viscous, transparent liquid containing no visible insoluble matter. The percent solids of the liquid mixture was determined to be 26.2% (w/w) using the thermogravimetric method described above. Subsequent determination of molecular weight was made using the GPC method described above: the copolymer had an $M_w$ of 251,300 Da and $M_w/M_n$ of 2.8 based on two independent measurements. The glass transition temperature was measured to be 120° C. using DSC, as described above The product is a copolymer of TCHMA and HEMA with a TMI grafting site attached to the HEMA and is designed herein as TCHMA/HEMA-TMI (97/3-4.7% w/w) and can be used to make an organosol.

Example 3

Example 3 was prepared using the method, apparatus, and materials described in Example 1. The cooled mixture was a viscous, transparent liquid containing no visible insoluble matter. The percent solids of the liquid mixture were determined to be 26.0% (w/w) using the thermogravimetric method described above. Subsequent determination of molecular weight was made using the GPC method described above; the copolymer had a $M_w$ of 201,050 and $M_w/M_n$ of 2.5 based on two independent measurements. The glass transition temperature was measured to be 126° C. using DSC, as described above. The product is a copolymer of TCHMA and HEMA containing random side chains of TMI and is designated herein as TCHMA/HEMA-TMI (97/3-4.7% w/w) and can be used to make an organosol.

Table 1 summarizes the graft stabilizers compositions of Examples 1 to 3.

TABLE 1

Graft Stabilizers

| Example Number | Graft Stabilizer Compositions (% w/w) | $T_g$ (° C.) | Solids (% w/w) | Molecular Weight $M_w$ | $M_w/M_n$ |
|---|---|---|---|---|---|
| 1 | TCHMA/HEMA-TMI (97/3-4.7% w/w) | 115 | 26.0 | 289,800 | 2.44 |
| 2 | TCHMA/HEMA-TMI (97/3-4.7% w/w) | 120 | 26.2 | 251,300 | 2.8 |
| 3 | TCHMA/HEMA-TMI (97/3-4.7% w/w) | 126 | 26.0 | 201,050 | 2.5 |

Organosol Preparation

Example 4

This example illustrates the use of the graft stabilizer in Example 2 to prepare an organosol with a core/shell ratio of 9/1. A 5000 ml, 3-neck round flask equipped with a condenser, a thermocouple connected to a digital temperature controller, a nitrogen inlet tube connected to a source of dry nitrogen and a mechanical stirrer was charged with a mixture of 2614 g of Norpar™12, 267.18 g of the graft stabilizer mixture from Example 2 @ 26.2% (w/w) polymer solids, 560 g of EMA, 49.63 g of AAD, and 9.45 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

Approximately 350 g of n-heptane was added to the cooled organosol. The resulting mixture was stripped of residual monomer using a rotary evaporator equipped with a dry ice/acetone condenser and operating at a temperature of 90° C. and using a vacuum of approximately 15 mm Hg. The stripped organosol was cooled to room temperature, yielding an opaque white dispersion.

This organosol was designed (TCHMA/HEMA-TMI//EMA/AAD) (97/3-4.7//91.9/8.1% w/w) and has a D/S ratio of 9/1 and can be used to prepare toner formulations. The percent solids of the organosol dispersion after stripping was determined to be 15.8% (w/w) using the thermogravimetric method described above. Subsequent determination of average particles size was made using the laser diffraction method described above; the organosol had a volume average diameter 53.3 μm. The glass transition temperature of the organosol polymer was measured using DSC, as described above, was 65° C.

Example 5

This example illustrates the use of the graft stabilizer in Example 1 to prepare an organosol with a D/S ratio of 8/1. A 2120 liter reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 689 kg of Norpar™12 fluid and 43.0 kg of the graft stabilizer mixture from Example 1 @ 25.4% (w/w) polymer solids along with an additional 4.3 kg of Norpar™12 fluid to rinse the pump. Agitation was then turned on at a rate of 65 RPM, and temperature was check to ensure maintenance at ambient. Next, 92 kg of EMA was added along with 12.9 kg of Norpar™12 fluid for rinsing the pump. Finally, 1.0 kg of V-601 was added, along with 4.3 kg of Norpar™12 fluid to rinse the container. A 40 torr vacuum was applied for 10 minutes and then broken by a nitrogen blanket. A second vacuum was pulled at 40 torr for an additional 10 minutes, and then agitation stopped to verify that no bubbles were coming out of the solution. The vacuum was then broken with a nitrogen blanket and a light flow of nitrogen of 14.2 liter/min was applied. Agitation of 75 RPM was resumed and the temperature of the reactor was heated to 75° C. and maintained for 5 hours. The conversion was quantitative.

The resulting mixture was stripped of residual monomer by adding 86.2 kg of n-heptane and 172.4 kg of Norpar™12 fluid and agitation was held at 80 RPM with the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and 360.6 kg of distillate was collected. A second strip was performed, following the above procedure and 281.7 kg of distillate was collected. The vacuum was then broken and the stripped organosol was cooled to room temperature, yielding an opaque white dispersion.

This organosol is designed TCHMA/HEMA-TMI//EMA (97/3-4.7//100% w/w). The percent solids of the organosol dispersion after stripping was determined as 13.3% (w/w) by the thermogravimetric method described above. Subsequent determination of average particles size was made using the light scattering method described above. The organosol particle had a volume average diameter of 42.3 μm. The glass transition temperature of the organosol polymer was measured to be 62.7° C. using DSC, as described above, was 62.7° C.

Example 6

This example illustrates the use of the graft stabilizer in Example 3 to prepare an organosol that has a D/S ratio of 8/1, using the method, apparatus, and materials of Example 5.

This organosol is designated TCHMA/HEMA-TMI//EMA (97/3-4.7//100% w/w). The percent solids of the organosol dispersion after stripping was determined as approximately 13.4% (w/w) by the thermogravimetric method described above. Subsequent determination of average particles size was made using the light scattering method described above; the organosol had a volume average diameter of 42.0 μm. The glass transition temperature was measured to be 70.13° C. using DSC, as described above.

Table 2 summarizes the organosol copolymer compositions of Examples 4 to 6.

TABLE 2

Organosols

| Example Number | Organosol Compositions (% w/w) (Core/shell (D/S) ratio) | $T_g$(° C.) | Particle Size (μm) |
|---|---|---|---|
| 4 | TCHMA/HEMA-TMI//EMA/AAD (97/3-4.7//92/8), D/S 9 | 65 | 53.3 |
| 5 | TCHMA/HEMA-TMI//EMA (97/3-4.7//100), D/S 8 | 62.7 | 42.3 |
| 6 | TCHMA/HEMA-TMI//EMA (97/3-4.7//100), D/S 8 | 70.13 | 42.0 |

Preparation of Liquid Toners and Subsequent Preparation of Dry Toners

Example 7

This example illustrates the use of the organosol in Example 4 to prepare a liquid toner and, subsequently, a dry toner. 1790 g of organosol @ 15.8% (w/w) solids in Norpar™12 was combined with 358 g of Norpar™12, 47 g of Black pigment (Aztech EK8200, Magruder Color Company, Tucson, Ariz.) and 4.43 g of 26.61% (w/w) Zirconium HEX-CEM solution. This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media (available from Morimura Bros. (USA) Inc., Torrence, Calif.). The mill was operated at 2000 RPM with chilled water circulating through the jacket of the milling chamber temperature at 21° C. Milling time was 61 minutes. The percent solids of the toner concentrate was determined to be 15.5% (w/w) using the thermogravimetric method described above. The properties of the liquid toner listed below were measured using the test methods described previously.

Volume Mean Particle Size: 6.21 micron
Q/M: 168 μC/g
Bulk Conductivity: 439 picoMhos/cm
Percent Free Phase Conductivity: 0.88%
Dynamic Mobility: 8.23E-11 ($m^2$/Vsec)

Dry Toner:

1540 g of the liquid toner in this example was dried using the toner drying procedure described above. The dried toner powders were measured for dryness using the thermogravimetric method described above. Table 3 summarizes the percent dryness of the dried toners for this example.

Example 8

114.04 kg of organosol from example 5 @ 13.30% (w/w) solids in Norpar™12 were combined with 22.58 kg of Norpar™12, 3.03 kg of Pigment Black EK8200 (Aztech Company, Tucson Ariz.) and 352.7 g of 25.8% (w/w) Zirconium HEX-CEM solution. This mixture was then milled in a Hockmeyer HSD Immersion Mill (Model HM-5, Hockmeyer Equipment Corp. Elizabeth City, N.C.) charged with 15 kg of 0.8 mm diameter Yttrium Stabilized Ceramic Media (available from Morimura Bros., (USA) Inc., Torrence, Calif.). The mill was operated at 1,364 RPM for 1 minute with hot water circulating through the jacket of the milling chamber at 80° C. and an additional 94 minutes at 45° C.

A 13% (w/w) solids toner concentrate exhibited the following properties as determined using the test methods described above:

Volume Mean Particle Size: 5.0 micron
Q/M: 181 μC/g
Bulk Conductivity: 340 picoMhos/cm
Percent Free Phase Conductivity: 1.72%
Dynamic Mobility: 7.15E-11($m^2$/Vsec)

Dry Toner:

1540 g of the liquid toner in this example was dried using the toner drying procedure described above. The dried toner powders were measured for dryness using the thermogravimetric method described above. Table 3 summarizes the percent dryness of the dried toners for this example.

Example 9

12,126.9 g of organosol from example 6 @ approximately 13.4% (w/w) solids in Norpar™12 was combined with 2,472.6 g of Norpar™12, 325.0 g of Pigment Black EK8200 (Aztech Company, Tucson), and 75.6 g of 25.8% (w/w) Zirconium HEX-CEM solution. This mixture was then milled in a Hockmeyer HSD Immersion Mill (Model HM1, Hockmeyer Equipment Corp. Elizabeth City, N.C.) charged with 4,175 g of 0.8 mm diameter Yttrium Stabilized Ceramic Media (Morimura Bros., (USA) Inc., Torrence, Calif.). The mill was operated at 2,500 RPM for 60 minutes with water circulating through the jacket of the milling chamber at 80° C. The mill was then cooled to 45° C. and the mixture milled and additional 35 minutes.

A 12.8% (w/w) solids toner concentrate exhibited the following properties as determined using the test methods described above:

Volume Mean Particle Size: 4.26 micron
Q/M: 361 μC/g
Bulk Conductivity: 525 picoMhos/cm
Percent Free Phase Conductivity: 2.40%
Dynamic Mobility: 9.32E-11 ($m^2$/Vsec)

Dry Toner:

1540 g of the liquid toner in this example was dried using the toner drying procedure described above. The dried toner powders were measured for dryness using the thermogravimetric method described above. Table 3 summarizes the percent dryness of the dried toners for this example.

Example 10

117.29 kg of organosol from example 5 @ 13.30% (w/w) solids in Norpar™12 were combined with 19.96 kg of Norpar™12, 2.6 kg of Pigment PB15:4S (Sun Chemical, Cincinnati, Ohio) and 152.9 g of 25.5% (w/w) Zirconium HEX-CEM solution). This mixture was then milled in a Hockmeyer HSD Immersion Mill (Model HM-5, Hockmeyer Equipment Corp. Elizabeth City, N.C.) charged with 15 kg of 0.8 mm diameter Yttrium Stabilized Ceramic Media (available from Morimura Bros., (USA) Inc., Torrence, Calif.). The mill was operated at 1364 RPM for 1 minute with hot water circulating through the jacket of the milling chamber at 80° C. and an additional 94 minutes at 45° C.

A 12.8% (w/w) solids toner concentrate exhibited the following properties as determined using the test methods described above:

Volume Mean Particle Size: 5.5 micron
Q/M: 120 μC/g
Bulk Conductivity: 90 picoMhos/cm
Percent Free Phase Conductivity: 0.78%
Dynamic Mobility: 3.05E-11($m^2$/Vsec)

Dry Toner:

1540 g of the liquid toner in this example was dried using the toner drying procedure described above. The dried toner powders were measured for dryness using the thermogravimetric method described above. Table 3 summarizes the percent dryness of the dried toners for this example.

Example 11

12473.3 g of organosol from example 6 @ approximately 13.4% (w/w) solids in Norpar™12 was combined with 2,183.3 g of Norpar™12, 278.6 g Pigment PB15:4S (Sun Chemical, Cincinnati, Ohio), and 64.8 g of 25.8% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4,175 g of 0.8 mm diameter Yttrium Stabilized Ceramic Media (Morimura Bros., (USA) Inc., Torrence, Calif.). The mill was operated at 2,500 RPM for 60 minutes with water circulating through the jacket of the milling chamber at 80° C. The mill was then cooled to 45° C. and the mixture milled and additional 35 minutes.

A 13% (w/w) solids toner concentrate exhibited the following properties as determined using the test methods described above:

Volume Mean Particle Size: 4.93 micron
Q/M: 269 μC/g
Bulk Conductivity: 358 picoMhos/cm
Percent Free Phase Conductivity: 0.92%
Dynamic Mobility: 7.44E-11 ($m^2$/Vsec)

Dry Toner:

1540 g of the liquid toner in this example was dried using the toner drying procedure described above. The dried toner powders were measured for dryness using the thermogravimetric method described above. Table 3 summarizes the percent dryness of the dried toners for this example.

Example 12

12473.3 g of organosol from example 6 @ approximately 13.4% (w/w) solids in Norpar™12 was combined with 2215.7 g of Norpar™12, 278.6 g Pigment PB15:4S (Sun Chemical, Cincinnati, Ohio), and 32.4 g of 25.8% (w/w) Zirconium HEX-CEM solution. This mixture was then milled in a Hockmeyer HSD Immersion Mill (Model HM1, Hockmeyer Equipment Corp. Elizabeth City, N.C.) charged with 4,175 g of 0.8 mm diameter Yttrium Stabilized Ceramic Media (Morimura Bros., (USA) Inc., Torrence, Calif.). The mill was operated at 2,500 RPM for 60 minutes with water circulating through the jacket of the milling chamber at 80° C. The mill was then cooled to 45° C. and the mixture milled and additional 35 minutes.

A 12.8% (w/w) solids toner concentrate exhibited the following properties as determined using the test methods described above:

Volume Mean Particle Size: 4.76 micron
Q/M: 264 μC/g
Bulk Conductivity: 333 picoMhos/cm
Percent Free Phase Conductivity: 1.01%
Dynamic Mobility: 7.60E-11 ($m^2$/Vsec)

Dry Toner:

1540 g of the liquid toner in this example was dried using the toner drying procedure described above. The dried toner powders were measured for dryness using the thermogravimetric method described above. Table 3 summarizes the percent dryness of the dried toners for this example.

TABLE 3

Percent solid/dryness of the dried organosol toners

| | Example # | | | | | |
|---|---|---|---|---|---|---|
| | 7 | 8 | 9 | 10 | 11 | 12 |
| Percent Solids (% w/w) | 97 | 97 | 95 | 97 | 96.5 | 95 |

Preparation of Re-Dispersed Toners in Norpar™ 12

Example 13

39.6 g of the dried toner from Example 7 were combined with 290.4 g of Norpar™12 in a 32 oz. bottle. The mixture in the bottle was mixed by hand-shaking, followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, toner viscosity and the functional printing were measured. Table 4 summarizes the test results of this example compared with the same test results for the original liquid toner of Example 7.

Example 14

45.5 g of the dried toner from Example 8 were combined with 304.5 g of Norpar™12 in a 32 oz. bottle. The mixture in the bottle was mixed by hand-shaking, followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, toner viscosity and the functional printing were measured. Table 4 summarizes the test results of this example compared with the same test results for the original liquid toner of Example 8.

Example 15

45.5 g of the dried toner from Example 9 were combined with 304.5 g of Norpar™12 in a 32 oz. bottle. The mixture in the bottle was mixed by hand-shaking, followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, toner viscosity and the functional printing were measured. Table 4 summarizes the test results of this example compared with the same test results for the original liquid toner of Example 9.

Example 16

45.5 g of the dried toner from Example 10 were combined with 304.5 g of Norpar™12 in a 32 oz. bottle. The mixture in the bottle was mixed by hand-shaking, followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, toner viscosity and the functional printing were measured. Table 5 summarizes the test results of this example compared with the same test results for the original liquid toner of Example 10.

Example 17

45.5 g of the dried toner from Example 11 were combined with 304.5 g of Norpar™12 in a 32 oz. bottle. The mixture in the bottle was mixed by hand-shaking, followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, toner viscosity and the functional printing were measured. Table 5 summarizes the test results of this example compared with the same test results for the original liquid toner of Example 11.

Example 18

45.5 g of the dried toner from Example 12 were combined with 304.5 g of Norpar™12 in a 32 oz. bottle. The mixture in the bottle was mixed by hand-shaking, followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, toner viscosity and the functional printing were measured. Table 5 summarizes the test results of this example compared with the same test results for the original liquid toner of Example 12.

Example 19

0.475 g of 25.8% (w/w) Zirconium HEX-CEM solution was added to 330 g of Example 15. The mixture in the bottle was mixed by hand-shaking, followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, toner viscosity and the functional printing were measured. Table 4 summarizes the test results of this example compared with the same test results for the original liquid toner of Example 9.

TABLE 4

Analytical test results of the original black toners and re-dispersed black liquid toners.

| Example | CCA (mg/g) | Solid (% w/w) | Conductivity (pMho/cm) | Particle Size Dv (μm) | Dn (μm) | % FPC | Q/M (μC/g) | Viscosity (cps) |
|---|---|---|---|---|---|---|---|---|
| 7 (Comparative) | 25 | 13.5 | 231 | 6.86 | 1.3 | — | 150 | 60 |
| 13 | | 12 | 127 | 5.98 | 1.15 | — | 105 | 11 |
| 8 (Comparative) | 30 | 13 | 340 | 5 | 1.3 | 1.72 | 181 | 42.5 |
| 14 | | 13 | 151 | 4.9 | 1.34 | 1.78 | 87 | 30 |
| 19 | +20 | | 330 | | | | | 25 |
| 9 (Comparative) | 60 | 12.8 | 525 | 4.26 | 0.97 | 2.4 | 361 | 55.5 |
| 15 | | 13 | 344 | 3.91 | 1.04 | 3.29 | 209 | 30 |

To obtain adequate charge level in the re-dispersed toner, additional charge control agent (e.g. Zirconium Hex-Cem) can be added in the re-dispersed toner as in the case of example 190. Adequate charge level can also be obtained through addition of excessive charge control agent to the original toner during toner milling and before toner powder drying as in the case of example 10. The same technique was used in the making of cyan re-dispersed toners shown below.

TABLE 5

Analytical test results of the original cyan toners and re-dispersed cyan liquid toners.

| Example | CCA (mg/g) | Solid (% w/w) | Conductivity (pMho/cm) | Molecular Weight Dv (μm) | Molecular Weight Dn (μm) | % FPC | Q/M (μC/g) | Viscosity (cps) |
|---|---|---|---|---|---|---|---|---|
| 10 (Comparative) | 15 | 12.8 | 90 | 5.5 | 0.56 | 0.78 | 120 | 62.5 |
| 16 | | 13 | 17 | 6.04 | 0.32 | 1.82 | 19 | 25 |
| 11 (Comparative) | 30 | 12.8 | 333 | 4.76 | 0.31 | 1.01 | 264 | 34.5 |
| 17 | | 13 | 198 | 5.07 | 0.36 | 1.4 | 239 | 24.5 |
| 12 (Comparative) | 60 | 13 | 358 | 4.93 | 0.31 | 0.92 | 269 | 41 |
| 18 | | 13 | 217 | 4.91 | 0.32 | 1.07 | 182 | 24 |

The primary difference among the original toners of example 10, example 11, and example 12 is the amount of charge director added during toner milling.

Print Testing

Using the test procedures described above, evaluation of the re-dispersed toners as well as the original toners were carried out using Laser 1000 paper (Georgia-Pacific, Atlanta, Ga.). After the toners in Examples 8-19 were print tested, they were observed for general appearance of the image (image quality), and the optical density ("OD") of the solid area was measured as described above. Tables 7 and 8 summarize the test results for the original toners before drying to obtain the dried powders and the re-dispersed toners from the dried powders. The visual observations summarized in Tables 7 and 8 described in Table 6, below.

TABLE 6

Visual assessment of the printed samples

| Print | Commentary |
|---|---|
| Excellent | No microvoids in the image. Image appears smooth and sharp |
| Good | A few microvoids on solid area. Image still appears smooth and sharp |
| Fair | Quite a few microvoids. Image appears papery |
| Poor | A lot of microvoids mingle with flow patterns in the image |

TABLE 7

Summaries of functional printing test results of the black toners

| Example | Print Quality | Flow pattern | OD |
|---|---|---|---|
| 7 (Comparative) | Excellent | No | 1.32 |
| 13 | Excellent | No | 1.34 |
| 8 (Comparative) | Good | Yes | 1.28 |
| 14 | Poor | Yes | 1.17 |
| 19 | Good | No | 1.36 |
| 9 (Comparative) | Fair | No | 1.11 |
| 15 | Good | No | 1.32 |

TABLE 8

Summaries of functional printing test results of the cyan toners

| Example | Print Quality | Flow pattern | OD |
|---|---|---|---|
| 10 Comparative) | Good | Yes | 1.2 |
| 16 | Poor | Yes | 1.18 |
| 11 (Comparative) | Fair | Yes | 1.13 |

TABLE 8-continued

Summaries of functional printing test results of the cyan toners

| Example | Print Quality | Flow pattern | OD |
|---|---|---|---|
| 17 | Good | No | 1.25 |
| 12 (Comparative) | Fair | Yes | 1.16 |
| 18 | Good | No | 1.24 |

Other embodiments of this invention will be apparent to those skilled in the art upon consideration of this specification or from practice of the invention disclosed herein. All patents, patent documents, and publications cited herein are incorporated by reference as if individually incorporated. Various omissions, modifications, and changes to the principles and embodiments described herein can be made by one skilled in the art without departing from the true scope and spirit of the invention which is indicated by the following claims.

The invention claimed is:

1. A method of preparing a liquid electrographic toner composition comprising a) preparing a polymeric binder comprising at least one amphipathic copolymer comprising one or more S material portions and one or more D material portions in a reaction solvent, wherein the reaction solvent comprises less than about 10% aromatic components by weight and has a Kauri-Butanol number less than about 30 mL;

b) formulating toner particles comprising the polymeric binder of step a) in the reaction solvent and a visual enhancement additive;

c) drying a plurality of toner particles as formulated in step b) to provide a dry toner particle composition; and d) redispersing the dry toner particle composition of step c) in a carrier liquid having substantially the same chemical constitution as the reaction solvent to form a redispersed liquid electrographic toner composition.

2. The method of claim 1, wherein the reaction solvent is a hydrocarbon solvent.

3. The method of claim 1, wherein the reaction solvent has a boiling point below about 250° C.

4. The method of claim 1, wherein the carrier liquid has a flash point above about 60° C.

5. The method of claim 1, wherein the reaction solvent is selected from the group consisting of aliphatic hydrocarbons, cycloaliphatic hydrocarbons, halogenated hydrocarbons, branched paraffinic solvents, aliphatic hydrocarbon solvents, and mixtures thereof.

6. The method of claim 1, wherein the carrier liquid is selected from the group consisting of branched paraffinic solvent blends, aliphatic hydrocarbon solvent blends, and mixtures thereof.

7. The method of claim 1, wherein the reaction solvent is selected from the group consisting of n-pentane, hexane, heptane, cyclopentane, cyclohexane, and mixtures thereof.

8. The method of claim 1, wherein the reaction solvent has a Hildebrand solubility parameter of from about 13 to about 15 $MPa^{1/2}$.

9. The method of claim 1, wherein the carrier liquid has a Hildebrand solubility parameter of from about 13 to about 15 $MPa^{1/2}$.

10. The method of claim 1, wherein the dry toner particle composition comprises a positive charge director.

11. The method of claim 10, wherein the positive charge director comprises a metal soap.

12. The method of claim 1, wherein the dry toner particle composition comprises a negative charge director.

13. The method of claim 1, wherein the dry toner particle composition is stored in the dry state for a period of at least about 3 weeks prior to redispersion in the carrier liquid.

14. The method of claim 1, wherein the toner particles have a volume mean particle diameter of from about 0.05 to about 50.0 microns.

15. The method of claim 1, wherein the toner particles have a volume mean particle diameter of from about 1.5 to about 10 microns.

16. The method of claim 1, wherein the toner particles have a volume mean particle diameter of from about 3 to about 5 microns.

17. The method of claim 1, wherein the S material portions comprise a plurality of anchoring groups, thereby providing an amphipathic copolymer having a plurality of links between the individual S material portions and the D material portions.

18. A product made by the process of claim 1.

19. A kit for forming a redispersed liquid electrographic toner composition comprising a) a dry toner particle composition prepared by ii) preparing a polymeric binder comprising at least one amphipathic copolymer comprising one or more S material portions and one or more D material portions in a reaction solvent, wherein the reaction solvent comprises less than about 10% aromatic components by weight and has a Kauri-Butanol number less than about 30 mL;

ii) formulating toner particles comprising the polymeric binder of step i) in the reaction solvent; and iii) drying a plurality of toner particles as formulated in step ii); and b) a carrier liquid, wherein the carrier liquid has substantially the same chemical constitution as the reaction solvent; and wherein the dry toner particle composition and the carrier liquid are provided in a format to facilitate redispersion of the dry toner particle composition in the carrier liquid to form a liquid electrographic toner composition.

* * * * *